US008871678B2

(12) United States Patent
Ohse et al.

(10) Patent No.: US 8,871,678 B2
(45) Date of Patent: Oct. 28, 2014

(54) THERMOSENSITIVE RECORDING MEDIUM

(75) Inventors: Katsuto Ohse, Tokyo (JP); Yukiko Satou, Tokyo (JP); Takurou Inoue, Tokyo (JP)

(73) Assignee: Nippon Paper Industries Co., Ltd., Tokyo (JP)

( * ) Notice: Subject to any disclaimer, the term of this patent is extended or adjusted under 35 U.S.C. 154(b) by 113 days.

(21) Appl. No.: 13/634,820

(22) PCT Filed: Jan. 28, 2011

(86) PCT No.: PCT/JP2011/051714

§ 371 (c)(1),
(2), (4) Date: Nov. 15, 2012

(87) PCT Pub. No.: WO2011/114780

PCT Pub. Date: Sep. 22, 2011

(65) Prior Publication Data

US 2013/0059728 A1 Mar. 7, 2013

(30) Foreign Application Priority Data

Mar. 15, 2010 (JP) ..... 2010-057439

(51) Int. Cl.
*B41M 5/41* (2006.01)

(52) U.S. Cl.
CPC ..... *B41M 5/41* (2013.01)
USPC ..... 503/200; 503/226

(58) Field of Classification Search
CPC ..... B41M 5/26–5/3377
USPC ..... 503/200–226
See application file for complete search history.

(56) References Cited

U.S. PATENT DOCUMENTS

| | | | |
|---|---|---|---|
| 4,032,690 | A | 6/1977 | Kohmura et al. |
| 4,243,716 | A | 1/1981 | Kosaka et al. |
| 4,265,978 | A | 5/1981 | Morishita et al. |
| 6,037,308 | A | 3/2000 | Sato et al. |
| 6,656,880 | B2 | 12/2003 | Aono |
| 6,680,281 | B2 | 1/2004 | Tajiri et al. |
| 7,157,407 | B2 | 1/2007 | Serizawa |
| 7,618,922 | B2 | 11/2009 | Ogino et al. |
| 8,129,307 | B2 | 3/2012 | Makihara et al. |

(Continued)

FOREIGN PATENT DOCUMENTS

| | | |
|---|---|---|
| CN | 1368578 | 9/2002 |
| EP | 0 465 665 | 1/1992 |

(Continued)

OTHER PUBLICATIONS

Extended European Search Report corresponding to European Patent Application No. 10 756 006.2-2304 dated Apr. 11, 2012.

(Continued)

*Primary Examiner* — Bruce H Hess
(74) *Attorney, Agent, or Firm* — Jenkins, Wilson, Taylor & Hunt, P.A.

(57) ABSTRACT

A thermosensitive recording medium having excellent image quality and surface strength is provided. The thermosensitive recording medium having excellent image quality and surface strength is obtained by containing a saturated fatty acid amide in the substrate to lower the density of the substrate. The thermosensitive recording medium of the present invention has an adequate general printability and problems such as print through are avoided. Furthermore, the thermosensitive recording medium of the present invention can assure adequate image quality and general printability even when an undercoat layer is not installed.

7 Claims, 1 Drawing Sheet

(56) References Cited

U.S. PATENT DOCUMENTS

| | | | |
|---|---|---|---|
| 8,247,347 | B2 | 8/2012 | Takagi et al. |
| 8,283,284 | B2 | 10/2012 | Hirai et al. |
| 8,466,085 | B2 | 6/2013 | Kato et al. |
| 8,492,308 | B2 | 7/2013 | Kurihara et al. |
| 8,609,582 | B2 | 12/2013 | Hirai et al. |
| 8,673,812 | B2 | 3/2014 | Ohse et al. |
| 2002/0121351 | A1 | 9/2002 | Takano et al. |
| 2003/0045426 | A1 | 3/2003 | Ito |
| 2004/0198603 | A1 | 10/2004 | Kawakami et al. |
| 2004/0241598 | A1 | 12/2004 | Suga et al. |
| 2005/0118526 | A1 | 6/2005 | Suga et al. |
| 2006/0264326 | A1 | 11/2006 | Fisher et al. |
| 2008/0139385 | A1 | 6/2008 | Ogino et al. |
| 2008/0214786 | A1 | 9/2008 | Oyama |
| 2010/0062935 | A1 | 3/2010 | Takagi et al. |
| 2010/0099557 | A1 | 4/2010 | Makihara et al. |
| 2010/0248959 | A1 | 9/2010 | Kato et al. |
| 2011/0105319 | A1 | 5/2011 | Hirai et al. |
| 2011/0130281 | A1 | 6/2011 | Kurihara et al. |
| 2011/0269622 | A1 | 11/2011 | Ohse et al. |
| 2012/0038737 | A1 | 2/2012 | Hirai et al. |
| 2012/0129692 | A1 | 5/2012 | Ohse et al. |

FOREIGN PATENT DOCUMENTS

| | | |
|---|---|---|
| EP | 0 764 635 | 3/1997 |
| EP | 0 779 539 | 6/1997 |
| EP | 1 116 713 | 7/2001 |
| EP | 1 199 185 | 4/2002 |
| EP | 1 367 437 | 12/2003 |
| EP | 1 437 231 | 7/2004 |
| EP | 1 747 898 | 1/2007 |
| EP | 1 808 304 | 7/2007 |
| EP | 2 072 274 | 6/2009 |
| EP | 2 145 771 | 1/2010 |
| GB | 2 187 297 | 9/1987 |
| JP | 53-091995 | 8/1978 |
| JP | 54-128349 | 10/1979 |
| JP | 57-165290 | 10/1982 |
| JP | 60-179190 | 9/1985 |
| JP | 60-179290 | 9/1985 |
| JP | 61-181680 | 8/1986 |
| JP | 61-291179 | 12/1986 |
| JP | 62-270383 | 11/1987 |
| JP | 1-196389 | 8/1989 |
| JP | 2-55188 | 2/1990 |
| JP | 03 047790 | 2/1991 |
| JP | 3-190786 | 8/1991 |
| JP | 3-205181 | 9/1991 |
| JP | 3-219993 | 9/1991 |
| JP | H04-164687 | 6/1992 |
| JP | 05-139033 | 6/1993 |
| JP | 5-162443 | 6/1993 |
| JP | 5221115 | 8/1993 |
| JP | H06155916 | 6/1994 |
| JP | 6-234275 | 8/1994 |
| JP | 6-262853 | 9/1994 |
| JP | H06-270547 | 9/1994 |
| JP | H06-286308 | 10/1994 |
| JP | 6-340171 | 12/1994 |
| JP | 7149713 | 6/1995 |
| JP | 07-179041 | 7/1995 |
| JP | H07-266711 | 10/1995 |
| JP | 07-314896 | 12/1995 |
| JP | H08-059603 | 3/1996 |
| JP | 08-207443 | 8/1996 |
| JP | 08-324123 | 12/1996 |
| JP | H08-333329 | 12/1996 |
| JP | H09-142018 | 6/1997 |
| JP | H09-207435 | 8/1997 |
| JP | H09-263047 | 10/1997 |
| JP | H10-250232 | 9/1998 |
| JP | H10-258577 | 9/1998 |
| JP | 10-272839 | 10/1998 |
| JP | H10-297089 | 11/1998 |
| JP | H10-297090 | 11/1998 |
| JP | 10-324062 | 12/1998 |
| JP | 10-324064 | 12/1998 |
| JP | 11-314454 | 11/1999 |
| JP | 2000-143611 | 5/2000 |
| JP | 2000-168242 | 6/2000 |
| JP | 2000-177243 | 6/2000 |
| JP | 3058758 | 7/2000 |
| JP | 2000-289333 | 10/2000 |
| JP | 2001-287459 | 10/2001 |
| JP | 2001-322358 | 11/2001 |
| JP | 2001-323095 | 11/2001 |
| JP | 2002-011954 | 1/2002 |
| JP | 2002-019300 | 1/2002 |
| JP | 2002-103789 | 4/2002 |
| JP | 2002-240430 | 8/2002 |
| JP | 2002-264538 | 9/2002 |
| JP | 2002-293023 | 10/2002 |
| JP | 2002-301873 | 10/2002 |
| JP | 2002-341770 | 11/2002 |
| JP | 2003-019861 | 1/2003 |
| JP | 2003-154760 | 5/2003 |
| JP | 2003-212841 | 7/2003 |
| JP | 3439560 | 8/2003 |
| JP | 2003-313795 | 11/2003 |
| JP | 2004-202913 | 7/2004 |
| JP | 2005-001281 | 1/2005 |
| JP | 2005-041013 | 2/2005 |
| JP | 2005-54331 | 3/2005 |
| JP | 2005-134578 | 5/2005 |
| JP | 2005-154996 | 6/2005 |
| JP | 2005-199554 | 7/2005 |
| JP | 2005-220480 | 8/2005 |
| JP | 2005-262549 | 9/2005 |
| JP | 3716736 | 11/2005 |
| JP | 2006-069032 | 3/2006 |
| JP | 3750786 | 3/2006 |
| JP | 2006-095852 | 4/2006 |
| JP | 2006-168319 | 6/2006 |
| JP | 3790648 | 6/2006 |
| JP | 2006-175835 | 7/2006 |
| JP | 2006-205561 | 8/2006 |
| JP | 2006-264255 | 10/2006 |
| JP | 2006-281472 | 10/2006 |
| JP | 2007-196616 | 8/2007 |
| JP | 2007-231485 | 9/2007 |
| JP | 3971453 | 9/2007 |
| JP | 2008-012879 | 1/2008 |
| JP | 2008-018619 | 1/2008 |
| JP | 2008-044226 | 2/2008 |
| JP | 2008-044227 | 2/2008 |
| JP | 2008-105222 | 8/2008 |
| JP | 2008-194918 | 8/2008 |
| JP | 2008-248408 | 10/2008 |
| JP | 2008-248459 | 10/2008 |
| JP | 2009-012247 | 1/2009 |
| WO | WO93/06074 | 4/1993 |
| WO | WO95/33714 | 12/1995 |
| WO | WO97/16420 | 5/1997 |
| WO | WO00/14058 | 3/2000 |
| WO | WO01/25193 | 4/2001 |
| WO | WO02/081229 | 10/2002 |
| WO | WO02/098674 | 12/2002 |
| WO | WO03/029017 | 4/2003 |
| WO | WO2004/002748 | 1/2004 |
| WO | WO2005/087503 | 9/2005 |
| WO | WO2005/087504 | 9/2005 |
| WO | WO2005/102725 | 11/2005 |
| WO | WO2006/075467 | 7/2006 |
| WO | WO2007/049621 | 5/2007 |
| WO | WO2008/099658 | 8/2008 |
| WO | WO2008/126635 | 10/2008 |
| WO | WO2008/139948 | 11/2008 |
| WO | WO2009/025316 | 2/2009 |
| WO | WO2009/028118 | 3/2009 |
| WO | WO2009/119813 | 10/2009 |

(56) References Cited

FOREIGN PATENT DOCUMENTS

| | | |
|---|---|---|
| WO | WO2010/110209 | 9/2010 |
| WO | WO2010/140662 | 12/2010 |
| WO | WO2011/114780 | 9/2011 |

OTHER PUBLICATIONS

International Search Report corresponding to International Patent Application No. PCT/JP2011/051714 dated Apr. 5, 2011.
Notice of Allowance corresponding to U.S. Appl. No. 12/599,617 dated Jun. 27, 2012.
Notice of Opposition corresponding to European Patent Application No. 08 752 259.5-1251/2145771 dated Jun. 14, 2012.
Notification of Transmittal of Translation of the International Preliminary Report on Patentability (Chapter I or Chapter II of the Patent Cooperation Treaty) corresponding to International Patent Application No. PCT/JP2011/051714 dated Nov. 8, 2012.
Official Action corresponding to U.S. Appl. No. 12/674,296 dated Jul. 9, 2012.
Official Action corresponding to U.S. Appl. No. 12/674,296 dated Feb. 6, 2013.
Supplemental Notice of Allowability corresponding to U.S. Appl. No. 12/599,617 dated Aug. 13, 2012.
Official Action corresponding to U.S. Appl. No. 13/254,381 dated May 28, 2013.
Official Action corresponding to U.S. Appl. No. 13/375,375 dated Jul. 11, 2013.
Japanese Technical Association of the Pulp and Paper Industry TAPPI No. 32-3:2000. "Paper-Water Absorption Test Method. Part 2: Water Drop Method." Test Report.
Notice of Allowance corresponding to U.S. Appl. No. 13/254,381 dated Sep. 25, 2013.
Notice of Allowance corresponding to U.S. Appl. No. 13/375,375 dated Nov. 7, 2013.
Official Action corresponding to Chinese Patent Application No. 201080024421.8 dated Jul. 29, 2013.
Official Action corresponding to U.S. Appl. No. 13/254,381 dated Aug. 22, 2013.
Extended European Search Report corresponding to European Patent Application No. 08 827 733.0-2304 dated Jan. 27, 2012.
European European Search Report corresponding to European Patent Application No. 09 725 687.9-2304 dated Feb. 24, 2012.
International Search Report corresponding to International Patent Application No. PCT/JP2007/074385 dated Feb. 14, 2008.
International Search Report corresponding to International Patent Application No. PCT/JP2008/051100 dated Apr. 15, 2008.
International Search Report corresponding to International Patent Application No. PCT/JP2008/054719 dated Sep. 22, 2008.
International Search Report corresponding to International Patent Application No. PCT/JP2008/058329 dated Jun. 9, 2008.
International Search Report corresponding to International Patent Application No. PCT/JP2008/064904 dated Oct. 7, 2008.
International Search Report corresponding to International Patent Application No. PCT/JP2009/056306 dated May 19, 2009.
International Search Report corresponding to International Patent Application No. PCT/JP2010/054818 dated Apr. 13, 2010.
International Search Report corresponding to International Patent Application No. PCT/JP2010/059462 dated Aug. 17, 2010.
Isogai et al., "Effects of Carboxyl Groups in Pulp on Retention of Alkylketene Dimer," Journal of Pulp and Paper Science. Vol. 23, No. 5 p. J215-J219 (1997).
Japanese Industrial Standard (JIS) P-8148. Paper, board and pulps—Measurement of diffuse blue reflectance factor (ISO brightness). Japanese Standards Association (2001).
Notice of Allowance corresponding to U.S. Appl. No. 12/520,514 dated Oct. 26, 2011.
Notice of Allowance corresponding to U.S. Appl. No. 12/593,116 dated May 15, 2012.
Notice of Allowance corresponding to U.S. Appl. No. 12/599,617 dated Apr. 16, 2012.
Notification Concerning Transmittal of International Preliminary Report on Patentability (Chapter I of the Patent Cooperation Treaty) corresponding to International Patent Application No. PCT/JP2009/056306 dated Oct. 7, 2010.
Notification Concerning Transmittal of International Preliminary Report on Patentability (Chapter I of the Patent Cooperation Treaty) corresponding to International Patent Application No. PCT/JP2010/054818 dated Sep. 24, 2011.
Notification of Transmittal of Translation of the on International Preliminary Reoirt on Patentability (Chapter I or Chapter II of the Patent Cooperation Treaty) corresponding to International Patent Application No. PCT/JP2007/074385 dated Mar. 18, 2010.
Notification of Transmittal of Translation of the International Preliminary Report on Patentability (Chapter I or Chapter II of the Patent Cooperation Treaty) corresponding to International Patent Application No. PCT/JP2008/051100 dated Aug. 27, 2009.
Notification of Transmittal of Translation of the International Preliminary Report on Patentability (Chapter I or Chapter II of the Patent Cooperation Treaty) corresponding to International Patent Application No. PCT/JP2008/054719 dated Oct. 29, 2009.
Notification of Transmittal of Translation of the International Preliminary Report on Patentability (Chapter I or Chapter II of the Patent Coopertaion Treaty) corresponding to International Patent Application No. PCT/JP2008/058329 dated Jan. 21, 2010.
Notification of Transmittal of Translation of the International Preliminary Report on Patentability (Chapter I or Chapter II of the Patent Cooperation Treaty) corresponding to International Patent Application No. PCT/JP2008/064904 dated Mar. 18, 2010.
Notification of Transmittal of Translation of the International Preliminary Report on Patentability (Chapter I or Chapter II of the Patent Cooperation Treaty) corresponding to International Patent Application No. PCT/JP2009/056306 dated Nov. 18, 2010.
Notification of Transmittal of Translation of the International Preliminary Report on Patentability (Chapter I or Chapter II of the Patent Cooperation Treaty) corresponding to International Patent Application No. PCT/JP2010/054818 dated Jan. 12, 2012.
Notification of Transmittal of Translation of the International Preliminary Report on Patentability (Chapter I or Chapter II of the Patent Cooperation Treaty) corresponding to International Patent Application No. PCT/JP2010/059462 dated Dec. 15, 2011.
Offical Action corresponding to U.S. Appl. No. 12/520,514 dated Mar. 10, 2010.
Offical Action corresponding to U.S. Appl. No. 12/520,514 dated Oct. 27, 2010.
Official Action corresponding to U.S. Appl. No. 12/593,116 dated Feb. 1, 2012.
Supplementary European Search Report corresponding to European Patent Application No. 08 703 912.9-1251/2112001 dated Jan. 22, 2010.
Supplementary European Search Report corresponding to European Patent Application No. 08 722 115.6-1251/2130681 dated Mar. 5, 2010.
Translation, "Explanation for filing a request for early examination," filed in the corresponding JP application (2007-282831) on Feb. 10, 2009.
Translation, "Opinion," filed in the corresponding JP application (2007-282831) on Mar. 24, 2009 in response to an office action of Mar. 9, 2009.
Translation, "Test Report," filed in the corresponding JP application (2007-282831) on Feb. 10, 2009.
Extended European Search Report corresponding to European Patent Application No. 07850858.7-1704 dated Apr. 10, 2014.
Supplementary European Search Report corresponding to European Patent Application No. 11755970.8-1704/2535202 dated Mar. 12, 2014.
Notice of Allowance corresponding to U.S. Appl. No. 12/674,296 dated Apr. 10, 2013.
Notice of Allowance corresponding to U.S. Appl. No. 12/675,701 dated Apr. 4, 2013.
Official Action corresponding to U.S. Appl. No. 12/934,230 dated Apr. 25, 2013.

THERMOSENSITIVE RECORDING MEDIUM

FIELD OF THE INVENTION

The present invention relates to a thermosensitive recording medium with a low density substrate obtained by containing a saturated fatty acid amide in the substrate, which has excellent color development sensitivity, image quality, surface strength and the like.

BACKGROUND OF THE INVENTION

Thermosensitive recording media are ordinarily prepared by mixing together a colorless or pale-colored electron donating leuco dye (henceforth referred to as "leuco dye") and an electron accepting color developing agent (henceforth referred to as "development agent"), such as a phenolic compound and the like, after grinding them into fine particles, preparing a coating solution by adding a binder, a filler, a sensitivity enhancing agent, a slipping agent and other aids to the mixture and applying the coating solution onto a substrate such as paper, synthetic paper, film, plastic and the like. Thermosensitive recording medium develops color through an instantaneous chemical reaction when heated using a thermal head, hot stamp, hot pen, laser light and the like and yields a recorded image. Thermosensitive recording media are used extensively in recording media such as facsimile devices, computer terminal printers, automatic ticket dispensers, recorders for meters, receipts at super markets and convenience stores and the like. Exceptional color development performance is sought in media that are used, for example, in handy terminal applications that are trending smaller, and high sensitivity, high resolution and excellent bar code readability are sought in label and ticket applications. Furthermore, opportunities to print advertisements and the like on the reverse media side are increasing when a thermosensitive recording medium is used as the recording medium for receipts and the like. Therefore, general printability (print through resistance, picking resistance during printing, ease of print processing and the like) is being sought in addition to qualities such as color development, sensitivity, image quality and the like that have previously been sought in thermosensitive recording media.

On the other hand, a low density paper containing fatty acid amides and the like is commonly known (Reference 1 etc.).

In addition, a thermosensitive recording medium with improved color development sensitivity prepared by lowering the thermal conductivity of the substrate by using a low density paper to which a non-ionic surfactant is added was disclosed (Reference 2). Thermosensitive recording media obtained using low density papers prepared by adding fatty acid amides, fatty acid esters and the like to the substrate were disclosed (References 3-5).

REFERENCES

Reference 1: Japanese Patent Application Public Disclosure No. 2008-248408

Reference 2: Japanese Patent Application Public Disclosure No. 2002-293023

Reference 3: Japanese Patent Application Public Disclosure No. 2005-1281

Reference 4: Japanese Patent Application Public Disclosure No. 2005-134578

Reference 5: Japanese Patent Application Public Disclosure No. 2005-154996

Problems to be Solved by the Invention

A paper with lowered density (low density paper) obtained by using a density reducing agent commonly has advantages such as being less likely to show the print on the surface when the reverse side is printed (print through) and having improved color development sensitivity since the thermal conductivity of the substrate is low. Therefore, based on these advantages, it is preferred to use a low density paper for a substrate of a thermosensitive recording medium.

However, when a low density paper is used as the substrate, the paper strength (that is, the strength of the paper itself) and the degree of surface smoothness tend to decline. Thus a thermosensitive recording medium using a low density paper as the substrate encounters problems such as lowered image quality, problems due to picking during printing and the like.

Lowered image quality is considered to be an uneven recording problem caused by record-free sections when a thermosensitive recording medium is recorded. The problem is thought to be caused by poor paper smoothness that prevents uniform printer head action.

In addition, picking refers to fluffing and stripping of the paper generated during printing, and the problem is thought to result because the adhesion of the paper surface to the coating layer (may be referred as the surface strength) being weaker than the ink tackiness on the coated surface.

In order to assure adequate image quality and general printability, an undercoat layer is commonly installed between the substrate (low density paper) and the thermosensitive recording layer of a thermosensitive recording medium (Reference 2 etc.).

The objective of the present invention is to present a thermosensitive recording medium with excellent color development sensitivity, print through resistance, image quality and picking resistance when using a low density paper (bulk paper) as the substrate.

Means to Solve the Problems

The density reducing agent used to manufacture a low density paper may be a surface active agent such as an oils and fats type non-ionic surfactant, sugar alcohol type non-ionic surfactant, a polyvalent alcohol type non-ionic surfactant and the like, a high molecular weight alcohol, an ethylene oxide or propylene oxide adduct of a high molecular weight alcohol or a high molecular weight fatty acid. However, the inventor discovered upon conducting a comparative study of density reducing agents that the presence of a specific fatty acid amide in the substrate of a thermosensitive recording medium imparted excellent image quality and general printability to the thermosensitive recording medium. The present invention was completed based on the results.

In general, a density reducing agent yields a low density substrate by reducing the inter-fiber bonding of cellulose fibers in a substrate and increases the space between fibers. However, the decline in inter-fiber bonding is associated with a decline in paper strength (that is, the strength of paper itself), and problems such as picking during printing are sometimes encountered as described above.

When a fatty acid amide is added to a substrate, the space between the cellulose fibers expands to yield a low density substrate. However, it is considered that the amide group in the fatty acid amide may form a bond with the cellulose fiber constructing the substrate or with the binder, pigment and the like in the coating solution applied to the substrate that may inhibit the reduction of inter-fiber bonding, improve film strength of the coated layer, and strengthen the bond between the coated layer and the substrate and the like. These factors are considered to contribute to good image quality and good general printability (picking resistance during printing and the like).

Furthermore, a thermosensitive recording medium was found to have excellent color development sensitivity and image quality when a saturated fatty acid was used as the fatty acid of the fatty acid amide.

That is, the present invention is a thermosensitive recording medium having a thermosensitive recording layer containing a colorless or pale electron donating leuco dye and electron accepting color developing agent on a substrate, wherein the substrate comprises a saturated fatty acid monoamide.

Advantages of the Invention

The thermosensitive recording medium of the present invention has better image quality and general printability due to the presence of a saturated fatty acid amide in the paper as the substrate compared to a thermosensitive recording media with a low density paper containing other density reducing agents as the substrate.

In addition, the saturated fatty acid amide used as a density reducing agent includes a saturated fatty acidmonoamide and a saturated fatty acid polyamide, and the properties of thermosensitive recording media obtained using these are different.

Thermosensitive recording media with a low density substrate prepared using a saturated fatty acid monoamide have particularly good color development sensitivity when compared to the thermosensitive recording media prepared using a saturated fatty acid polyamide. And good recorded intensity is derived from good color development sensitivity.

In addition, thermosensitive recording media containing low density substrates prepared using a saturated fatty acid polyamide have good contact with printer heads regardless of paper smoothness and yield extremely good image quality and fine resolution images.

In addition, the thermosensitive recording medium of the present invention has an improved heat insulation performance since the density of the substrate is lowered, and can efficiently transmit the heat supplied by a heat generating source to the thermosensitive recording layer. As a result, the recorded intensity improves and problems such as print through are avoided.

Furthermore, the thermosensitive recording medium of the present invention can assure adequate image quality and general printability even when an undercoat layer is not installed.

DETAILED DESCRIPTION OF THE INVENTION

Figure 1:
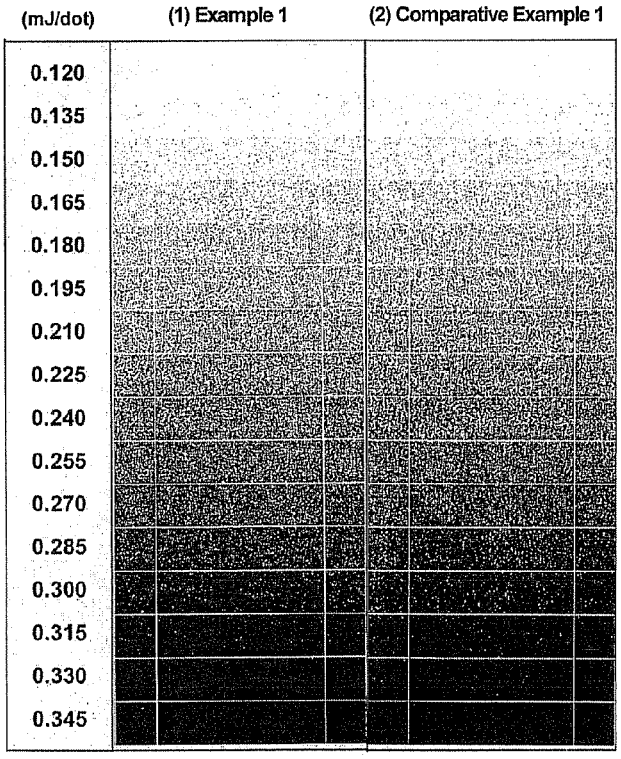
FIG. 1 shows the condition of the recorded surface of a thermosensitive recording medium. (1) shows the material from Example 1. (2) shows the material from Comparative Example 1. The numbers on the left show applied energy (mJ/dot).

The substrate used in the present invention contains a saturated fatty acid amide.

While the fatty acid component of the fatty acid amide includes saturated fatty acids such as lauric acid, palmitic acid, stearic acid, behenic acid and the like and unsaturated fatty acids such as oleic acid, linoleic acid and the like, a saturated fatty acid is used in the present invention (that is, the fatty acid component of the fatty acid amide is a saturated fatty acid). When a saturated fatty acid amide is used in the substrate, the color development sensitivity and image quality are excellent (see Table 1). In addition, linear saturated fatty acids containing from 12 to 22 carbon atoms, preferably from 16 to 18 carbon atoms, are preferred among the saturated fatty acids.

In addition, the amine constituting the saturated fatty acid amide is monoamine.

Saturated fatty acid monoamides are represented by the general formula $RCONH_2$, wherein R represents a group excluding the carboxylic acid group from the saturated fatty acid constituting the saturated fatty amide. R is a saturated hydrocarbon group in the case of a saturated fatty acid amide and is a linear saturated hydrocarbon group in the case of a linear saturated fatty acid amide.

As clearly shown by the Examples presented later, the color development sensitivity of a thermosensitive recording medium was much better when a saturated fatty acid monoamide was used than when a saturated fatty acid polyamide was used, which results in good performance such as print intensity, print through and the like (see Table 1). The use of a saturated fatty acidmonoamide was particularly preferred when recording was executed using a low applied energy (for example, 0.20 mJ/dot or lower) since the color development sensitivity was pronouncedly superior and is suited for high speed recording and recording using a recording device with a low output (low applied energy) such as a handy terminal.

It is considered that the presence of a saturated fatty acidmonoamide in a substrate accelerates the color development reaction of the color developing agent present in the thermosensitive recording layer, since a saturated fatty acid monoamide has a structure similar to that of the sensitizer in a thermosensitive recording medium.

As the saturated fatty acid monoamide, lauric acid monoamides, palmitic acid monoamides, stearic acid monoamides, behenic acid monoamides and the like may be cited.

As the saturated fatty acid polyamide, lauric acid polyamides, palmitic acid polyamides, stearic acid polyamides, behenic acid polyamides and the like may be cited.

As clearly shown by the Examples presented later, the resolution of the record is excellent when a saturated fatty acid polyamide is used and the thermosensitive recording medium is recorded. The resolution refers to more finely recorded details when a thermosensitive recording medium is recorded. Recording is executed by heating a thermosensitive recording layer or a protective layer on top of a thermosensitive recording layer using a printer head and the like. In such a case, good contact between the thermosensitive recording layer on a substrate or the protective layer on top and the printer head is thought to produce more uniform recording.

The saturated fatty acid amide may be used individually or as a mixture of at least two of them. In addition, fatty acid amides (mainly unsaturated fatty acid amides although unsaturated fatty acid amides and saturated fatty acid amides other than the saturated fatty acid amides of the present invention may be included) other than the saturated fatty acid amides of the present invention may be used in combination as needed in a range that does not interfere with the desired effects of the present invention described above. In the present invention, the content of the saturated fatty acid amide of the present invention is preferably at least 50% by weight, more preferably at least 70% by weight, particularly preferably at least 90% by weight, of the sum total of the saturated fatty acid amide of the present invention and fatty acid amides other than the saturated fatty acid amide of the present invention. In addition, in the present invention, the content of the saturated fatty acid monoamide of the present invention is preferably at least 50% by weight, more preferably in at least 70% by weight, of the sum total of the saturated fatty acid amide used.

The content of the saturated fatty acid amide of the present invention in a substrate may be suitably adjusted within the range that yields a desired effect. However, the content is preferably from 0.1% by weight to 1% by weight of the pulp contained in the substrate for a good balance between the bulking effect and surface strength. When the content of the saturated fatty acid amide is greater than 0.1% by weight, an adequate bulking effect is easy to obtain. In addition, when the content of the saturated fatty acid amide of the present invention is less than 1% by weight, problems such as picking and the like during printing caused by a reduction in paper strength and the like and an image quality decline in a thermosensitive recording medium due to a reduction of the surface smoothness and the like are less likely to occur.

The saturated fatty acid amide of the present invention is ordinarily used in the form of an emulsion that is emulsified and dispersed. The emulsion can be obtained, for example, by placing a saturated fatty acid amide in an emulsification device such as a homogenizer along with hot water and an emulsifier and emulsifying and dispersing the mixture with heating the mixture to a temperature above the fusion temperature during the emulsification. Emulsified particles with good particle size distribution can be obtained by appropriately adjusting the type and the amount of the emulsifier, the agitation intensity during emulsification, the emulsification time and the like. The emulsifier may be one of anionic, cationic, non-ionic and amphoteric emulsifiers or combination of at least two of them.

Emulsified particles with smaller particle diameter are preferred since they have much greater bulking effect based on the amount added and are less likely to cause paper strength declines in substrates. The average particle diameter of emulsified particles measured using a laser diffraction scattering method is ordinarily from about 0.3 μm to 20 μm.

The substrate used in the present invention is made of pulp, such as chemical pulp (softwood bleached Kraft pulp (NBKP), softwood unbleached Kraft pulp (NUKP), hardwood bleached Kraft pulp (LBKP), hardwood unbleached Kraft pulp (LUKP) and the like), mechanical pulp (ground pulp (GP), refined ground pulp (RGP), semi-chemical pulp (SCP), chemical-ground pulp (CGP), thermo-mechanical pulp (TMP) and the like), non-wood pulp and the like. These may be formulated as necessary depending on the required quality for the substrate.

Filler may also be added to a substrate to improve the degree of brightness and degree of opacity. The amount of fillers added is not particularly restricted, but the amount is preferably adjusted to from 2% to 20% of the ash content in the substrate. Now, pulp fiber tangling is adversely affected when the substrate ash content exceeds 20%, and the risk that sufficient strength may not be achieved exists. The ash content of the substrate is measured according to JIS P8251.

In the present invention, chemicals ordinarily used in paper making processes such as various paper making aids such as a paper strengthener, de-foaming agent, coloring agent and the like, for example, may also be appropriately added to a substrate as needed.

The paper making method for a substrate is not particularly restricted, and a long screen machine and a circular screen machine containing a top wire and the like, machines that combine them both and the like may be used. In addition, the paper making method may be appropriately selected from an acidic paper making method and a neutral paper making method and is not particularly restricted.

And pigments that enhances the surface smoothness and whiteness of the substrate, water-soluble polymer or emulsions of hydrophobic polymer that enhances the surface strength, surface sizing agent that imparts water absorption resistance, etc. may also be coated on the substrate or impregnated in the substrate by using a size press, pre-metering size press, gate roll coater, etc.

As the water-soluble polymer or emulsions of hydrophobic polymer, starches such as starch, enzyme modified starch, thermochemically modified starch, oxidized starch, esterified starch, etherified starch (for example, hydroxy ethylated starch and the like), cationic starch and the like; poly(vinyl alcohols) such as poly(vinyl alcohol), completely saponified poly(vinyl alcohol), partially saponified poly(vinyl alcohol), carboxyl modified poly(vinyl alcohol), silanol modified poly (vinyl alcohol), cation modified poly(vinyl alcohol), terminal alkyl modified poly(vinyl alcohol the like; water-soluble polymer such as polyacrylamides such as polyacrylamide, cationic polyacrylamide, anionic polyacrylamide, amphoteric polyacrylamide and the like; emulsions of hydrophobic polymer such as styrene-butadiene copolymers, poly(vinyl acetate), vinyl chloride-vinyl acetate copolymers, poly(vinyl chloride), poly(vinylidene chloride), poly(acrylate esters) and the like may be cited. These substances may be used solely or as mixtures of at least two.

As the sizing agent, styrene-maleic acid type copolymer resins, α-olefin-maleic acid type copolymer resins, acrylate ester-acrylic acid) and type copolymer resins, cationic sizing agent, alkyl ketene dimer (AKD) and the like may be cited and the sizing agent is not particularly restricted. However, the sizing agent of alkyl ketene dimer is preferred.

The coating solution may also contain various aids such as a dispersion agent, plasticizing agent, pH controlling agent, de-foaming agent, water retention agent, preservative, coloring dye, ultraviolet ray inhibitor and the like when needed.

The solid content of a coating solution is appropriately adjusted according to the composition, coating device and the like but is ordinarily from about 5 wt. % to 15 wt. % and the dried coating amount is from 5 g/m$^2$ to 15 g/m$^2$.

The density of the paper used in the present invention can be lowered (low density paper), since the paper which is the substrate of the present invention contains a saturated fatty acid amide. However, even if the substrate contains a saturated fatty acid amide, the density of the substrate can be made higher or lower, for example, by adjusting the manufacturing conditions such as treating the substrate with calendar, depending on the required quality for the thermosensitive recording medium.

The density of the low density paper of the present invention is less than 0.95 g/cm$^3$, preferably from 0.60 to 0.85 g/cm$^3$, more preferably from 0.65 to 0.85 g/cm$^3$, particularly preferably at least 0.65 g/cm$^3$ and less than 0.85 g/cm$^3$. The density is measured according to JIS P8118.

The thermosensitive recording medium has a thermosensitive recording layer on the substrate.

Next, the various materials used for the thermosensitive recording layer and other coating layer(s) are listed. However, a pigment, a binder, a cross linking agent, etc. can be used also for each coating layer(s) in the range which does not inhibit the desired effect for the problems described above.

All of the leuco dyes well known in the conventional field of pressure sensitive and thermosensitive recording media may be used as the leuco dye in a thermosensitive recording medium of the present invention. Although the dye is not particularly restricted, triphenylmethane type compounds, fluorane type compounds, fluorene type compounds, divinyl type compounds and the like are preferred. Specific examples of the typical colorless to pale colored basic colorless dye are shown below. In addition, these basic colorless dyes may be used individually or also in mixtures of at least two of them.

<Triphenylmethane Type Leuco Dyes>

3,3-bis(p-dimethyl aminophenyl)-6-dimethylaminophthalide [alternate name: crystal violet lactone] and 3,3-bis(p-dimethyl aminophenyl)phthalide [alternate name: malachite green lactone]

<Fluorane Type Leuco Dyes>

3-Diethylamino-6-methylfluorane, 3-diethylamino-6-methyl-7-anilinofluorane, 3-diethylamino-6-methyl-7-(o,p-dimethylanilino)fluorane, 3-diethylamino-6-methyl-7-chlorofluoran, 3-diethylamino-6-methyl-7-(m-trifluoromethylanilino)fluorane, 3-diethylamino-6-methyl-7-(o-chloroanilino)fluorane, 3-diethylamino-6-methyl-7-(p-chloroanilino)fluorane, 3-diethylamino-6-methyl-7-(o-fluoroanilino)fluorane, 3-diethylamino-6-methyl-7-(m-methylanilino)fluorane, 3-diethylamino-6-methyl-7-n-octylanilino fluorane, 3-diethylamino-6-methyl-7-n-octylamino fluorane, 3-diethylamino-6-methyl-7-benzylamino fluorane, 3-diethylamino-6-methyl-7-dibenzylamino fluorane; 3-diethylamino-6-chloro-7-methyl fluorane, 3-diethylamino-6-chloro-7-anilino fluorane, 3-diethylamino-6-chloro-7-p-methylanilino fluorane, 3-diethylamino-6-ethoxyethyl-7-anilino fluorane, 3-diethylamino-7-methyl fluorane, 3-diethylamino-7-chloro fluorane, 3-diethylamino-7-(m-trifluoromethylanilino)fluorane, 3-methylamino-7-(o-chloroanilino)fluorane, 3-diethylamino-7-(p-chloroanilino)fluorane, 3-diethylamino-7-(o-fluoroanilino)fluorane, 3-diethylamino-benz[a]fluorine; 3-diethylamino-benz[c]fluorane, 3-dibutylamino-6-methylfluorane, 3-dibutylamino-6-methyl-7-anilino fluorane, 3-dibutylamino-6-methyl-7-(o,p-dimethylanilino)fluorane, 3-dibutylamino-7-(o-chloroanilino)fluorane, 3-butylamino-6-methyl-7-(p-chloroanilino)fluorane, 3-dibutylamino-6-methyl-7-(o-fluoroanilino)fluorane, 3-dibutylamino-6-methyl-7-(m-fluoroanilino)fluorane, 3-dibutylamino-6-methylchloro fluorane, 3-dibutylamino-6-ethoxyethyl-7-anilino fluorane, 3-dibutylamino-6-chloro-7-anilino fluorane, 3-dibutylamino-6-methyl-7-p-methylanilino fluorane, 3-dibutylamino-7-(o-chloroanilino)fluorane, 3-dibutylamino-7-(o-fluoroanilino)fluorane, 3-di-n-pentylamino-6-methyl-7-anilino fluorane, 3-di-n-pentylamino-6-methyl-7-(p-chloroanilino)fluorane, 3-di-n-pentylamino-7-(m-trifluoromethylanilino)fluorane, 3-di-n-pentylamino-6-chloro-7-anilino fluorane, 3-di-n-pentylamino-7-(p-chloroanilino)fluorane, 3-pyrolidino-6-methyl-7-anilino fluorane, 3-piperidino-6-methyl-7-anilino fluorane, 3-(N-methyl-N-propylamino)-6-methyl-7-anilino fluorane, 3-(N-methyl-N-cyclohexylamino)-6-methyl-7-anilino fluorane, 3-(N-ethyl-N-cyclohexylamino)-6-methyl-7-anilino fluorane, 3-(N-ethyl-N-xylylamino)-6-methyl-7-(p-chloroanilino)fluorane, 3-(N-ethyl-p-toluidino)-6-methyl-7-anilino fluorane, 3-(N-ethyl-N-isoamylamino)-6-methyl-7-anilino fluorane, 3-(N-ethyl-N-isoamylamino)-6-chloro-7-anilino fluorane, 3-(N-ethyl-N-tetrahydrofurfurylamino)-6-methyl-7-anilino fluorane, 3-(N-ethyl-N-isobutylamino)-6-methyl-7-anilino fluorane, 3-(N-ethyl-N-ethoxypropylamino)-6-methyl-7-anilino fluorane, 3-cyclohexylamino-6-chloro fluorane, 2-(4-oxahexyl)-3-dimethylamino-6-methyl-7-anilino fluorane, 2-(4-oxahexyl)-3-diethylamino-6-methyl-7-anilino fluorane, 2-(4-oxahexyl)-3-dipropylamino-6-methyl-7-anilino fluorane, 2-methyl-6-p-(p-dimethylaminophenyl)aminoanilino fluorane, 2-methoxy-6-p-(p-dimethylaminophenyl)aminoanilino fluorane, 2-chloro-3-methyl-6-(p-phenylaminophenyl)aminoanilino fluorane, 2-chloro-6-p-(p-dimethylaminophenyl)aminoanilino fluorane, 2-nitro-6-p-(p-diethylaminophenyl)aminoanilino fluorane, 2-amino-6-p-(p-diethylaminophenyl)aminoanilino fluorane, 2-diethylamino-6-p-(p-diethylaminophenyl)aminoanilino fluorane, 2-phenyl-6-methyl-6-p-(p-phenylaminophenyl)aminoanilino fluorane, 2-benzyl-6-p-(p-phenylaminophenyl)aminoanilino fluorane, 2-hydroxy-6-p-(p-phenylaminophenyl)aminoanilino fluorane, 3-methyl-6-p-(p-dimethylaminophenyl)aminoanilino fluorane, 3-diethylamino-6-p-(p-diethylaminophenyl)aminoanilino fluorane, 3-diethylamino-6-p-(p-dibutylaminophenyl)aminoanilino fluorane and 2,4-dimethyl-6-[(4-dimethylamino)anilino]fluorane.

<Fluorene Type Leuco Dye>

3,6,6-Tris(dimethylamino)spiro[fluorene-9,3'-phthalide] and 3,6,6'-tris(diethylamino)spiro[fluorene-9,3'-phthalide].

<Divinyl Type Leuco Dyes>

3,3-bis-[2-(p-dimethyl aminophenyl)-2-(p-methoxyphenyl)ethenyl]-4,5,6,7-tetrabromophthalide, 3,3-bis-[2-(p-dimethylaminophenyl)-2-(p-methoxyphenyl)ethenyl]-4,5,6,7-tetrachlorophthalide, 3,3-bis-[1,1-bis(4-pyrolidinophenyl)ethylene-2-yl]-4,5,6,7-tetrabromophthalide and 3,3-bis-[1-(4-methoxyphenyl)-1-(4-pyrolydinophenyl)ethylene-2-yl]-4,5,6,7-tetrchlorophthalide.

<Others>

3-(4-Diethylamino-2-ethoxyphenyl)-3-(1-ethyl-2-methylindol-3-yl)-4-azaphthalide, 3-(4-diethylamino-2-ethoxyphenyl)-3-(1-octyl-2-methylindol-3-yl)-4-azaphthalide, 3-(4-cyclohexyl ethylamino-2-methoxyphenyl)-3-(1-ethyl-2-methylindol-3-yl)-4-azaphthalide, 3,3-bis(1-ethyl-2-methylindol-3-yl)phthalide, 3,6-bis(diethylamino)fluorane-γ-(3'-nitro)anilinolactam, 3,6-bis(diethylamino)fluorane-γ-(4'-nitro)anilinolactam, 1,1-bis-[2',2',2",2"-tetrakis-(p-dimethylaminophenyl)-ethenyl]-2,2-dinitrilethane, 1,1-bis-[2',2',2",2"-tetrakis-(p-dimethylaminophenyl)-ethenyl]-2-β-naphthoylethane, 1,1-bis-[2',2',2",2"-tetrakis-(p-dimethylaminophenyl)-ethenyl]-2,2-diacetylethane and bis-[2,2,2',2'-tetrakis-(p-dimethylaminophenyl)-ethenyl]-methylmalonic acid dimethyl ester.

All of the color development agents well known in the conventional field of pressure sensitive and thermosensitive recording media may be used as the color development agent in a thermosensitive recording medium of the present invention. Although the dye is not particularly restricted, activated clay, attapulgite, colloidal silica, inorganic acidic substances such as aluminum silicate and the like, 4,4'-isopropylidene diphenol, 1,1-bis(4-hydroxyphenyl)cyclohexane, 2,2-bis(4-hydroxyphenyl)-4-methylpentane, 4,4'-dihydroxydiphenyl sulfide, hydroquinone monobenzyl ether, benzyl 4-hydroxybenzoate, 4,4'-dihydroxy diphenyl sulfone, 2,4'-dihydroxy diphenyl sulfone, 4-hydroxy-4'-isopropxy diphenyl sulfone, 4-hydroxy-4'-n-propoxy diphenyl sulfone, bis(3-allyl-4-hydroxyphenyl)sulfone, 4-hydroxy-4'-methyl diphenyl sulfone, 4-hydroxyphenyl-4'-benzyloxyphenyl sulfone, 3,4-dihydroxyphenyl-4'-methyl phenyl sulfone, aminobenzene sulfonamide derivatives described in Japanese Patent Application Public Disclosure No. H08-59603, bis(4-hydroxyphenyl thioethoxy)methane, 1,5-di(4-hydroxyphenyl thio)-3-oxapentane, butyl bis(p-hydroxyphenyl)acetate, methyl bis(p-hydroxyphenyl)acetate, 1,1-bis(4-hydroxyphenyl)-1-phenyl ethane, 1,4-bis[α-methyl-α-(4'-hydroxyphenyl)ethyl]benzene, 1,3-bis[α-methyl-α-(4'-hydroxyphenyl)ethyl]benzene, di(4-hydroxy-3-methylphenyl)sulfide, 2,2'-thiobis(3-tert-octylphenol), 2,2'-thiobis(4-tert-octylphenol), phenolic compounds such as diphenyl sulfone crosslinked compounds and the like described in International Publication WO97/16420, phenolic compounds described in International Publication WO02/081229 or Japanese Patent Application Public Disclosure No. 2002-301873, thiourea compounds such as N,N'-di-m-chlorophenyl thiourea and the like, p-chlorobenzoic acid, stearyl gallate, bis[zinc 4-octyloxy carbonylamino]salicylate dihydrate, 4-[2-(p-methoxyphenoxy)ethyloxy]salicylic acid, 4-[3-(p-trisulfonyl)propyloxy]salicylic acid, aromatic carboxylic acids such as 5-[p-(2-p-methoxyphenoxyethoxy) cumyl]salicylic acid and salts of these aromatic carboxylic acids and polyvalent metals such as zinc, magnesium, aluminum, calcium, titanium, manganese, tin, nickel and the like, and, furthermore, antipirin complexes of zinc thiocyanate and complex zinc salts and the like of terephthal aldehyde acid with other aromatic carboxylic acids, for example, may be cited. These color development agents may be used individually and in mixtures of at least two. The diphenylsulfone crosslinked type compound described in International Publication WO97/16420 is available under the trade name of D-90 produced by Nippon Soda Co., Ltd. The compound described in International Publication WO02/081229 is also available under the trade names of NKK-395 and D-100 produced by Nippon Soda Co., Ltd. In addition, high molecular weight aliphatic acid metal complex salts described in Japanese Patent Application Public Disclosure No. H10-258577 and metal chelate type color development components such as polyvalent hydroxy aromatic compounds and the like may also be present.

The previously well known sensitizers may be used as the sensitizer in the present invention. As such sensitizers, aliphatic acid amides such as stearic acid amide, palmitic acid amide and the like, ethylene bis-amide, montan acid wax, polyethylene wax, 1,2-di-(3-methylphenoxy)ethane, p-benzyl biphenyl, β-benzyloxy naphthalene, 4-biphenyl-p-tolyl ether, m-terphenyl, 1,2-diphenoxyethane, dibenzyl oxalate, di(p-chlorobenzyl)oxalate, di(p-methylbenzyl)oxalate, dibenzyl terephthalate, benzyl p-benzyloxy benzoate, di-p-tolyl carbonate, phenyl-α-naphthyl carbonate, 1,4-diethoxynaphthalene, 1-hydroxy-2-naphthoic acid phenyl ester, o-xylene-bis-(phenyl ether), 4-(m-methyl phenoxymethyl) biphenyl, 4,4'-ethylene dioxy-bis-benzoic acid dibenzyl ester, dibenzoyloxy methane, 1,2-di(3-methylphenoxy)ethylene, bis[2-(4-methoxy-phenoxy)ethyl]ether, methyl p-nitrobenzoate and phenyl p-toluene sulfonate may be listed as examples, but the sensitizer is not particularly limited to these examples. These sensitizers may be used individually and as mixtures of at least two of them.

As a pigment, kaolin, calcined kaolin, calcium carbonate, aluminum oxide, titanium oxide, magnesium carbonate, aluminum silicate, magnesium silicate, calcium silicate, aluminum hydroxide, silica and the like may be used. These pigments may be used in combinations depending on the required quality.

As the binder used in the present invention, completely saponified poly(vinyl alcohol), partially saponified poly(vinyl alcohol), acetoacetylated poly(vinyl alcohol), carboxyl modified poly(vinyl alcohol), amide modified poly(vinyl alcohol), sulfonic acid modified poly(vinyl alcohol), butyral modified poly(vinyl alcohol), olefin modified poly(vinyl alcohol), nitrile modified poly(vinyl alcohol), pyrolidone modified poly(vinyl alcohol), silicone modified poly(vinyl alcohol), other modified poly(vinyl alcohol), hydroxyethyl cellulose, methyl cellulose, ethyl cellulose, carboxymethyl cellulose, styrene-maleic anhydride copolymers, styrene-butadiene copolymers as well as cellulose derivatives such as ethyl cellulose, acetyl cellulose and the like, casein, gum Arabic, starch oxide, etherified starch, dialdehyde starch, esterified starch, poly(vinyl chloride), poly(vinyl acetate), polyacrylamide, poly(acrylate esters), poly(vinyl butyral), polystyrose and copolymers thereof, polyamide resins, silicone resins, petroleum resins, terpene resins, ketone resins, cumaron resins and the like may be listed as examples. The polymeric substances may be used upon dissolving them in a solvent such as water, alcohol, ketones, esters, hydrocarbons and the like or upon emulsifying or dispersing into a paste in water or other media. The polymeric materials may also be used in combinations according to the qualities demanded.

As the crosslinking agent used in the present invention, glyoxal, methylol melamine, melamine formaldehyde resins, melamine urea resins, polyamine epichlorohydrin resins, polyamide epichlorohydrin resins, potassium persulfate, ammonium persulfate, sodium persulfate, ferric chloride, magnesium chloride, borate sand, boric acid, alum, ammonium chloride and the like may be listed as examples.

As the slipping agent used in the present invention, fatty acid metal salts such as zinc stearate, calcium stearate, and the like, wax, silicone resins and the like may be cited.

In addition, a stabilizing agent that instills oil resistance in recorded images such as 4,4'-butylidene (6-t-butyl-3-methylphenol), 2,2'-di-t-butyl-5,5'-dimethyl-4,4'-sulfonyl diphenol, 1,1,3-tris(2-methyl-4-hydroxy-5-cyclohexylphenyl)butane, 1,1,3-tris(2-methyl-4-hydroxy-5-t-butylphenyl)butane, 4-benzyloxy-4'-(2,3-epoxy-2-methyl propoxy)diphenylsulfone and the like may also be added in the range that does not adversely affect the desired effects for the problems described above.

In addition, a benzophenone type and triazole type UV light absorption agent, dispersion agent, de-foaming agent, antioxidant, fluorescent dye and the like may also be used.

The types and amounts of the leuco dye, color developing agent, sensitizer and other various ingredients used in the thermosensitive recording medium of the present invention are determined according to the required performance and printability and are not particularly restricted. However, from 0.5 parts to 10 parts of the color developing agent, from 0.5 parts to 20 parts of the pigment, from 0.5 parts to 10 parts of the sensitizer, from 0.01 parts to 10 parts of the stabilizing agent and from 0.01 parts to 10 parts of the other ingredients are ordinarily used per 1 part of the leuco dye.

The leuco dye, the color developing agent and materials added when needed are finely ground into particles, several microns or smaller in size, using a grinder or a suitable emulsification device such as a ball mill, attritor, sand grinder and the like, and a coating solution is prepared by adding a binder and various additive materials depending on the objective. Water, alcohol and the like can be used as the solvent for the coating solution and the solid content of the coating solution is about from 20 to 40 wt %.

While thermosensitive recording medium of the present invention has a thermosensitive recording layer on the substrate, other coating layer(s) other than the thermosensitive recording layer may be installed. For example, an undercoat layer between the thermosensitive recording layer and the substrate, a protective layer on the thermosensitive recording layer, a back coat layer on the opposite side of the thermosensitive recording layer of the substrate may be installed.

The undercoat layer comprises mainly a binder and a pigment.

As the binder used for the undercoat layer, commonly used emulsions of a water soluble polymer or a hydrophobic polymer and the like may be used appropriately. As specific examples, poly(vinyl alcohol), poly(vinyl acetal), cellulose derivatives such as hydroxyethyl cellulose, methyl cellulose, carboxymethyl cellulose and the like, starch and its derivatives, poly(sodium acrylate), poly(vinyl pyrolidone), acrylic acid amide/acrylate ester copolymers, acrylic acid amide/acrylate ester/methacrylic acid copolymers, styrene/maleic anhydride copolymer alkali salts, isobutylene/maleic anhydride copolymer alkali salts, polyacrylamide, sodium alginate, water soluble polymers such as gelatin, casein and the like, emulsions of hydrophobic polymers such as poly(vinyl acetate), polyurethane, styrene/butadiene copolymers, poly (acrylic acid), poly(acrylate esters), vinyl chloride/vinyl acetate copolymers, poly(butyl methacrylate), ethylene/vinyl acetate copolymers, styrene/butadiene/acrylic copolymers and the like may be used. These binders may be used individually or in combinations of at least two.

As a pigment used for the undercoat layer, well-known pigments commonly used previously may be used. As specific examples, inorganic pigments such as calcium carbonate, silica, zinc oxide, titanium oxide, aluminum hydroxide, magnesium hydroxide, sintered kaolin, clay, talc and the like may be used. These pigments may be used individually or in combinations of at least two.

The pigment in the undercoat layer is ordinarily from 50 wt. % to 95 wt. %, preferably from 70 wt. % to 90 wt. % per total solid fraction.

Various aids such as a dispersion agent, plasticizer, pH controlling agent, de-foaming agent, water retention agent, preservative, coloring dye, UV light inhibiting agent and the like may also be appropriately added to the coating solution for the undercoat layer.

The protective layer contains pigments and resins as main components. As the resins, water soluble polymers such as poly(vinyl alcohol), starch and the like may be used.

It is preferred that the protective layer contains 1) a resin containing carboxyl groups, epichlorohydrin type resins and polyamine type resin/polyamide type resins or 2) an acrylic resin with a glass transition temperature of higher than 50 degree C. and lower than or equal to 95 degree C. in view of heat resistance, water resistance and humidity resistance.

As the resin containing carboxyl group, a carboxy modified poly(vinyl alcohol) may be preferably cited. As the epichlorohydrin resins, poly(amide epichlorohydrin) resins, poly (amine epichlorohydrin) resins and the like may be preferably cited. As the polyamine/amide resin, polyamide urea resins, polyalkylene polyamine resins, polyalkylene polyamide resins, polyamine polyurea resins, modified polyamine resins, modified polyamide resins, polyalkylene polyamine urea formalin resins, and polyalkylene polyamine polyamide polyurea resins may be cited.

The acrylic resin contains (meth)acrylic acid and a monomer that can be copolymerized with (meth)acrylic acid. The monomer element that can be copolymerized with (meth) acrylic acid includes, for example, alkyl acrylic acid resin, such as methyl(meth)acrylate, ethyl(meth)acrylate, propyl(meth)acrylate, iso-butyl(meth)acrylate, pentyl(meth)acrylate, hexyl(meth)acrylate, 2-ethyl hexyl(meth)acrylate, octyl (meth)acrylate and the like, modified alkyl acrylic acid resin, such as alkyl acrylic acid resin as above that is modified with epoxy resin, silicone resin, styrene or these derivatives, (meth)acrylonitrile, acrylic ester and hydroxy-alkyl acrylic ester. The acrylic resin is preferably a non-core-shall type acrylic resin.

In the present invention, the method for coating the thermosensitive recording layer and the other coating layer than the thermosensitive recording layer is not limited in particular, but any well-known conventional techniques may be used. The method for coating may be appropriately selected and used among, for example, off-machine coater and on-machine coater, which is equipped with coaters such as air knife coater, rod blade coater, bent blade coater, bevel blade coater, roll coater, curtain coater.

The coating amount of the thermosensitive recording layer or the other coating layer than the thermosensitive recording layer is not limited in particular, but the typical dried coating amount of the thermosensitive recording layer is ordinarily in the range of from 2 to 12 g/m$^2$.

Furthermore, various technologies known in the thermosensitive recording medium field may be used as needed, for example, a flattening treatment such as super calendaring and the like can be conducted after coating individual coating layers.

EXAMPLES

The following Examples will illustrate the present invention, but these are not intended to restrict the present invention. In the following description, the terms parts and % indicate parts by weight and wt. %, respectively. The freeness of pulp (Canadian Standard Freeness, hereinafter referred to as "CSF") is measured according to JIS (Japanese Industrial Standards) P8121. The density of the substrate is measured according to JIS P8118. The smoothness of the thermosensitive recording surface side of the substrate (The surface to which an undercoat layer or a thermosensitive recording layer is installed.) is measured according to JIS P8155 (oken method). As the smoothness (in seconds) is higher, the surface is smoother.

Example 1

Substrate

LBKP with CSF of 300 ml was used as a stock pulp. Paper stock was prepared by formulating 1.0% of stearic acid monoamide (N327, Chukyo Yushi Co., Ltd., solid content 30%) and 0.15% of alkyl ketene dimer (AKD) as a sizing agent per the solid content of the stock pulp, and adding calcium carbonate so that the ash content of the substrate is 15%. Then the substrate paper was made from the paper stock by using Fourdrinier paper machine and a coating solution (solvent: water) comprising 7.0% of hydroxyethylated starch (STANLEY Co., ETHYLEX2035) and 0.08% of surface sizing agent (Seiko PMC Corporation, SK ResinS-25) was applied on both sides of the substrate paper by using a gate roll coater so that the dried coating amount of both sides is 0.5 g/m$^2$. Then the substrate paper was super calendared so that the density of the substrate is 0.85 g/cm$^3$ (the basic weight is 58 g/m$^2$ and the thickness is 68 μm.) to yield a paper support with 64 seconds of the smoothness of the thermosensitive recording surface side.

Undercoat Layer

Then the undercoat layer coating solution below was applied on one side of the paper substrate and was dried to prepare an undercoated paper with a coating amount of 7.0 g/m$^2$.

Undercoat Layer Coating Solution

| | |
|---|---|
| Calcined kaolin (Engelhard Co., Ansilex 90) | 100 parts |
| Styrene-butadiene copolymer latex (Zeon Corporation, ST5526, solid content: 48%) | 40 parts |
| Aqueous solution of completely saponified polyvinyl alcohol (Kuraray Co., Ltd. PVA117, solid content: 10%) | 30 parts |
| Water | 146 parts |

Thermosensitive Recording Layer

A color development agent dispersion (solution A), a dye dispersion (solution B) and a sensitizer dispersion (solution C) with the following formulation were separately wet ground using sand grinders until the average particle size was about 0.5 μm.

Solution A (Color Development Agent Dispersion)

| | |
|---|---|
| 4-Hydroxy-4'-isopropoxy diphenyl sulfone (API Corporation, NYDS) | 6.0 parts |
| Aqueous solution of completely saponified polyvinyl alcohol (Kuraray Co., Ltd. PVA117, solid content: 10%) | 18.8 parts |
| Water | 11.2 parts |

Solution B (Leuco Dye Dispersion)

| | |
|---|---|
| 3-Dibutylamino-6-methyl-7-anilinofluorane (Yamamoto Chemicals Inc. ODB-2) | 2.0 parts |
| Aqueous solution of completely saponified polyvinyl alcohol (Kuraray Co., Ltd. PVA117, solid content: 10%) | 4.6 parts |
| Water | 2.6 parts |

Solution C (Sensitizer Dispersion)

| | |
|---|---|
| Diphenyl sulfone | 6.0 parts |
| Aqueous solution of completely saponified polyvinyl alcohol (Kuraray Co., Ltd. PVA117, solid content: 10%) | 18.8 parts |
| Water | 11.2 parts |

Next the dispersions were blended in the proportion described below to prepare a thermosensitive recording layer coating solution.

Thermosensitive Recording Layer Coating Solution

| | |
|---|---|
| Solution A (color development agent dispersion) | 36.0 parts |
| Solution B (leuco dye dispersion) | 9.2 parts |
| Solution C (sensitizer dispersion) | 36.0 parts |
| Kaolin clay (50% dispersion) | 12.0 parts |

This thermosensitive recording layer coating solution was applied on the undercoat layer of substrate obtained above with a coating amount of 3.0 g/m$^2$ and was dried. Then the prepared sheet was super calendared in a condition with 100 kN/m of line pressure to yield a thermosensitive recording medium.

Example 2

A thermosensitive recording medium was prepared in the same manner as described in Example 1 with the exception that the substrate was super calendared so that the basic weight is 58 g/m$^2$ and the density is 0.70 g/cm$^3$. The smoothness of the thermosensitive recording surface side was 25 seconds.

Comparative Example 7

A thermosensitive recording medium was prepared in the same manner as described in Example 1 with the exception that stearic acid diamide was used instead of stearic acid monoamide in preparing the paper stock and the substrate was super calendared so that the density is 0.85 g/cm$^3$ (basic weight is 58 g/m$^2$ and the thickness is 68 μm.). The smoothness of the thermosensitive recording surface side was 64 seconds.

Comparative Example 8

A thermosensitive recording medium was prepared in the same manner as described in Comparative Example 7 with the exception that the substrate was super calendared so that the density is 0.70 g/cm$^3$ (basic weight is 58 g/m$^2$ and the thickness is 83 μm.). The smoothness of the thermosensitive recording surface side was 20 seconds.

Comparative Example 1

A thermosensitive recording medium was prepared in the same manner as described in Example 1 with the exception that stearic acid monoamide was not used in formulating the substrate and the substrate was super calendared so that the basic weight is 58 g/m$^2$ and the density is 1.00 g/cm$^3$. The smoothness of the thermosensitive recording surface side was 110 seconds.

Comparative Example 2

A thermosensitive recording medium was prepared in the same manner as described in Example 1 with the exception that the substrate was super calendared so that the basic weight is 58 g/m$^2$ and the density is 1.00 g/cm$^3$. The smoothness of the thermosensitive recording surface side was 95 seconds.

Comparative Example 3

A thermosensitive recording medium was prepared in the same manner as described in Example 1 with the exception that oleic acid diamide was used instead of stearic acid monoamide in preparing the paper stock and the substrate was super calendared so that the basic weight is 58 g/m$^2$ and the density is 0.70 g/cm$^3$. The smoothness of the thermosensitive recording surface side was 23 seconds.

Comparative Example 4

A thermosensitive recording medium was prepared in the same manner as described in Example 1 with the exception that saturated fatty acid ester of polyhydric alcohol (Kao Corporation, KB115, solid content 30%) was used instead of stearic acid monoamide in preparing the paper stock and the substrate was super calendared so that the basic weight is 58 g/m$^2$ and the density is 0.70 g/cm$^3$. The smoothness of the thermosensitive recording surface side was 25 seconds.

Example 3

A thermosensitive recording medium was prepared in the same manner as described in Example 2 with the exception that the undercoat layer was not installed.

Comparative Example 9

A thermosensitive recording medium was prepared in the same manner as described in Comparative Example 8 with the exception that the undercoat layer was not installed.

Comparative Example 5

A thermosensitive recording medium was prepared in the same manner as described in Comparative Example 3 with the exception that the undercoat layer was not installed.

Comparative Example 6

A thermosensitive recording medium was prepared in the same manner as described in Comparative Example 4 with the exception that the undercoat layer was not installed.

The thermosensitive recording media obtained in the manners described above were evaluated as follows.

<Recorded Density>

The thermosensitive recording surface of the prepared thermosensitive recording medium was recorded a gradational pattern by using a recording tester for thermosensitive recording paper (Okura Engineering Co. LTD., TH-PMD) at recording energy of 0.35 mJ/dot and 0.195 mJ/dot. The density of the recorded image was measured by using Macbeth Densitometer (RD-914, with Amber filter).

<Image Quality>

The thermosensitive recording surface of the prepared thermosensitive recording medium was recorded a gradational pattern by using a recording tester (Okura Engineering Co. LTD., TH-PMD) at recording energy of from 0.120 mJ/dot to 0.240 mJ/dot in increments of 0.015 mJ/dot. Then the recorded area was evaluated by naked eyes. The difference of the image quality was significant at relatively low recording energy, especially from 0.120 mJ/dot to 0.225 mJ/dot.

Excellent: No uneven color development was observed in the recorded area.

Good: Slight uneven color development was observed in the recorded area.

Fair: Uneven color development and slight unrecorded area were observed in the recorded area.

Poor: Much unrecorded area was observed in the recorded area.

Figure 2:
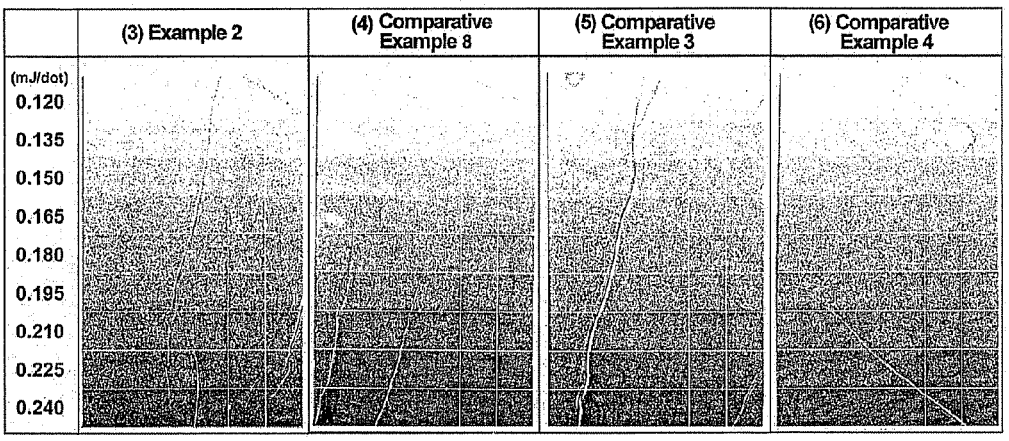
FIG. 2 shows the condition of the recorded surface of a thermosensitive recording medium. (3) shows the material from Example 2 (density reducing agent: stearic acidmonoamide) (4) shows the material from Comparative Example 8 (density reducing agent: stearic acid diamide) (5) shows the material from Comparative Example 3 (density reducing agent: oleic acid diamide) (6) shows the material from Comparative Example 4 (density reducing agent: stearic acid diester) The numbers on the left show applied energy (mJ/dot).

Among the evaluated thermosensitive recording media, the recorded papers after evaluation of Examples 1 and 2 (density reducing agent: stearic acidmonoamide), Comparative Example 8 (density reducing agent: stearic acid diamide), Comparative Example 1 (no density reducing agent), Comparative Example 3 (density reducing agent: oleic acid diamide) and Comparative Example 4. (density reducing agent: stearic acid diester) are shown in FIGS. 1 and 2.

<Surface Strength>

The thermosensitive recording surface of the prepared thermosensitive recording medium was printed with an ink for sheet-fed offset press (Toyo Ink Co., Ltd. Hi-unity M) by using a sheet-fed offset printing machine manufactured by Roland Corporation. Then the surface strength (picking resistance) was evaluated on the solidly printed area by visually inspecting fluffing and stripping.

Excellent: No fluffing or stripping was observed

Good: Almost no fluffing or stripping was observed

Fair: Slight fluffing or stripping was observed

Poor: Much fluffing or stripping was observed

<Print Through Resistance/Bar Code Readability>

The surface opposite to the surface with the thermosensitive recording layer of the thermosensitive recording medium was printed with a black ink for rotary offset press by using RI printer and dried. The surface with the thermosensitive recording layer of the thermosensitive recording medium was recorded with a bar code (CODE39) using a label printer 140XiIII manufactured by Zebra Co., Ltd. The recorded bar code was evaluated by using a bar code reader (Quick Check PC 600 manufactured by Nihon Systex Ltd.). The evaluation was conducted using the ANSI grades (used ten of measurements).

Print through refers to a phenomenon in which, when printed on a substrate containing a density reducing agent, the recorded thermosensitive recording surface becomes difficult to read because the printed ink penetrates to the opposite side of the substrate.

If the evaluation is rated greater than or equal to 1.5, no practical problem was experienced when reading bar codes. If the evaluation is rated less than 1.5, problems were encountered as far as bar code readability was concerned.

The results are shown in the table below.

TABLE 1

| | | Substrate | | | Quality of Thermosensitive recording medium | | | | |
|---|---|---|---|---|---|---|---|---|---|
| | Density reducing agent | Density (g/cm$^3$) | Smoothness of thermosensitive recording layer side (sec.) | Undercoat layer | Recorded density (0.35 mJ/dot) | Recorded density (0.195 mJ/dot) | Image quality | Surface strength | Print through resistance |
| Example 1 | stearic acid monoamide | 0.85 | 64 | installed | 1.35 | 0.45 | Good | Excellent | 1.9 |
| Example 2 | stearic acid monoamide | 0.70 | 25 | " | 1.35 | 0.45 | Good | Excellent | 2.8 |
| Comparative Example 7 | stearic acid diamide | 0.85 | 64 | " | 1.32 | 0.43 | Excellent | Excellent | 1.8 |
| Comparative Example 8 | stearic acid diamide | 0.70 | 20 | " | 1.30 | 0.43 | Excellent | Excellent | 2.6 |
| Comparative Example 1 | — | 1.00 | 110 | " | 1.31 | 0.32 | Fair | Excellent | 1.5 |
| Comparative Example 2 | stearic acid monoamide | 1.00 | 95 | " | 1.34 | 0.45 | Good | Excellent | 1.2 |
| Comparative Example 3 | oleic acid diamide | 0.70 | 23 | " | 1.19 | 0.33 | Good | Good | 2.0 |
| Comparative Example 4 | stearic acid diester | 0.70 | 25 | " | 1.28 | 0.33 | Fair | Fair | 2.6 |
| Example 3 | stearic acid monoamide | 0.70 | 25 | NA | 1.28 | 0.31 | Good | Good | 2.3 |

TABLE 1-continued

| | | Substrate | | | Quality of Thermosensitive recording medium | | | | |
|---|---|---|---|---|---|---|---|---|---|
| | Density reducing agent | Density ($g/cm^3$) | Smoothness of thermosensitive recording layer side (sec.) | Undercoat layer | Recorded density (0.35 mJ/dot) | Recorded density (0.195 mJ/dot) | Image quality | Surface strength | Print through resistance |
| Comparative Example 9 | stearic acid diamide | 0.70 | 20 | " | 1.20 | 0.30 | Good | Good | 2.2 |
| Comparative Example 5 | oleic acid diamide | 0.70 | 23 | " | 1.14 | 0.21 | Good | Good | 1.7 |
| Comparative Example 6 | stearic acid diester | 0.70 | 25 | " | 1.12 | 0.20 | Poor | Poor | 1.5 |

As shown in FIG. 1, the thermosensitive recording medium of Example 1 is recorded evenly (FIG. 1 (1)), while the thermosensitive recording medium of Comparative Example 1 shows uneven recording (FIG. 1 (2)), which is significant where recording was less intense. The results indicate that the density of a substrate is lowered due to the presence of a saturated fatty acid amide in the substrate, the heat insulation properties of the substrate improves, and the heat supplied by a heat generating device can be efficiently transferred to the thermosensitive recording layer to yield good recording performance.

When a saturated fatty acid amide (stearic acid amide) is used as a density reducing agent (Examples 1-3 and Comparative Examples 7-9), image quality and print through resistance are better than those observed in the absence of a density reducing agent (Comparative Example 1), image quality, recorded density and surface strength are better than those observed when a fatty acid ester (stearic acid ester) is used as a density reducing agent (Comparative Examples 4 and 6), and color development sensitivity and image quality are better than those observed when an unsaturated fatty acid amide (oleic acid diamide) is used (Comparative Examples 3 and 5).

Furthermore, when a saturated fatty acid amide (stearic acidmonoamide) is used but the density of the substrate is high (Comparative Example 2), print through resistance is poor and recorded density is slightly worse than that observed when the density is lowered (Example 1).

When a saturated fatty acid monoamide (stearic acidmonoamide) is used (Examples 1-3), the recorded density and print through resistance are much better than those observed when a saturated fatty acid polyamide (stearic acid diamide) is used (Comparative Examples 7-9). When comparing FIG. 2 (3) and (4) at lower applied energy area (about 0.195 mJ/dot or less), the use of a saturated fatty acid monoamide (stearic acidmonoamide) (FIG. 2 (3)) yielded particularly better color development sensitivity. This difference is reflected in the better recorded density in Examples 1-3 than that in Comparative Examples 7-9 in Table 1.

What is claimed is:

1. A thermosensitive recording medium having a thermosensitive recording layer containing a colorless or pale electron donating leuco dye and an electron accepting color developing agent on a substrate, wherein the substrate comprises a fatty acid amide and the density of the substrate is from 0.60 to 0.95 $g/cm^3$, further wherein the fatty acid amide is a saturated fatty acid monoamide or a mixture of saturated fatty acid monoamides.

2. The thermosensitive recording medium of claim 1, wherein the density of the substrate is from 0.65 to 0.85 $g/cm^3$.

3. The thermosensitive recording medium of claim 2, wherein an undercoat layer is not installed between the thermosensitive recording layer and the substrate.

4. The thermosensitive recording medium of claim 1, wherein the saturated fatty acid monoamide is a linear saturated fatty acid monoamide.

5. The thermosensitive recording medium of claim 4, wherein an undercoat layer is not installed between the thermosensitive recording layer and the substrate.

6. The thermosensitive recording medium of claim 1, wherein an undercoat layer is not installed between the thermosensitive recording layer and the substrate.

7. The thermosensitive recording medium of claim 1, wherein the surface opposite to the surface with the thermosensitive recording layer of the thermosensitive recording medium is printed.

* * * * *